US005269459A

United States Patent [19]

Thompson et al.

[11] Patent Number: 5,269,459

[45] Date of Patent: Dec. 14, 1993

[54] THERMALLY RESPONSIVE EXPANSION VALVE

[75] Inventors: Michael R. Thompson, Carol Stream; Peter G. Malone, Park Ridge; Peter J. Malone, Mount Prospect, all of Ill.

[73] Assignee: Eaton Corporation, Cleveland, Ohio

[21] Appl. No.: 900,621

[22] Filed: Jun. 18, 1992

Related U.S. Application Data

[63] Continuation of Ser. No. 777,945, Oct. 17, 1991, abandoned.

[51] Int. Cl.[5] ..... F25B 41/04

[52] U.S. Cl. ..... 236/92 B; 62/225

[58] Field of Search ..... 62/225; 236/92 B

[56] References Cited

U.S. PATENT DOCUMENTS 3,537,645 11/1970 Treder ..... 236/92 B
3,667,247 6/1972 Proctor ..... 62/225 X
3,810,366 5/1974 Orth ..... 62/225 X
3,817,053 6/1974 Orth ..... 62/225 X
3,822,563 7/1974 Orth ..... 62/225 X
4,542,852 9/1985 Orth et al. ..... 62/225 X

*Primary Examiner*—William E. Tapolcai
*Attorney, Agent, or Firm*—R. A. Johnston

[57] ABSTRACT

A refrigerant expansion valve has a pressure-responsive diaphragm forming a wall of a fluid filled chamber. The diaphragm is connected to one end of an actuator rod incorporating a hollow with a closed end opposite and operative to move a valve member for controlling flow between an inlet and outlet. The actuator member has the hollow communicating with the fluid filled chamber and its external surface exposed to return refrigerant flow. Fluid communications between the hollow of the actuator member and the fluid filled chamber is restricted by an orifice in a plug in the open end of the hollow to dampen the effects of sudden temperature changes of the return flow over the hollow. Preferably, the actuator member, plug, and diaphragm are commonly clamped, sealed, and welded together.

4 Claims, 4 Drawing Sheets

FIG. 4
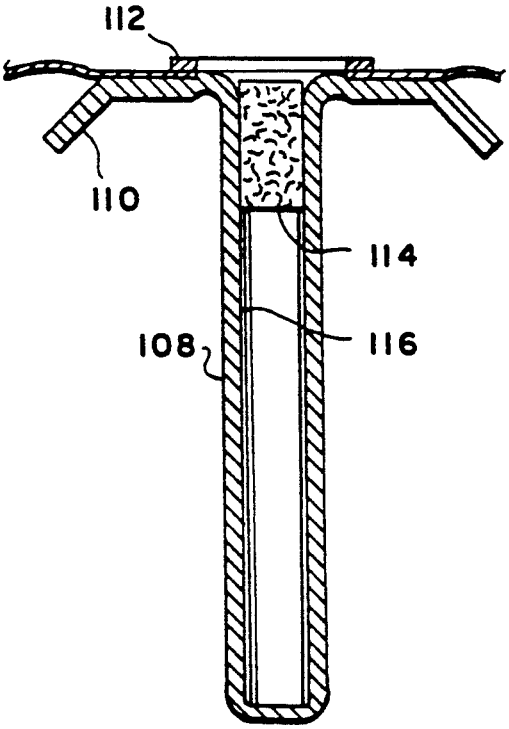
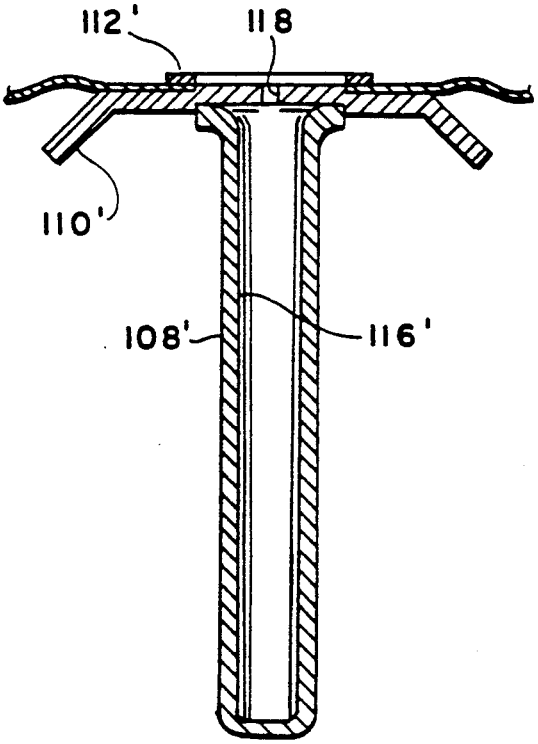
FIG. 5

THERMALLY RESPONSIVE EXPANSION VALVE

This application is a continuation of application Ser. No. 777,945, filed Oct. 17, 1991, now abandoned.

BACKGROUND OF THE INVENTION

The present invention relates to expansion valves of the type employed for controlling flow of refrigerant fluid in air conditioning and refrigeration systems. Typically, in air conditioning systems, such as those employed for automobile passenger compartment cooling an expansion valve throttles the flow of pressurized liquid refrigerant at relatively high pressures from the condenser to provide relatively low pressure flow to an evaporator and return therefrom to the compressor. In particular, expansion valves employed for controlling flow of liquid refrigerant to an evaporator in an automotive air conditioning system are of the type known as a "block" valve, wherein the valve body or block has a separate return flow passage therethrough in which vaporized refrigerant discharged from the evaporator passes to permit temperature and pressure thermal sensing thereof for control purposes.

It is known, for example to provide an actuator rod for moving the expansion valve and to expose the rod to the refrigerant flowing in the return passage to the compressor for heat transfer therebetween. It is also known to employ the heat transfer through the rod to provide a temperature signal which in turn operates a pressure-responsive means connected to the actuator rod for controlling the function of the expansion valve in response to changes in the temperature of the refrigerant discharging from the evaporator. It is also known to provide a fluid filled chamber having pressurized fluid therein which acts upon a diaphragm as the pressure-responsive means to move the valve actuator rod control member; and, to having a portion of the rod filled with the pressurized fluid to thereby be in heat transfer relationship with the refrigerant flowing through the return passage to the compressor inlet.

It is known to provide a refrigerant expansion valve which has a hollow tubular member 1 attached to a diaphragm 2 sensing the pressure in the fluid filled chamber formed by a capsule 3 above the diaphragm with the hollow actuator rod extending through the compressor return passage and adapted for moving the control valve member. In valve constructions of this latter type, the hollow actuator rod may experience sudden changes in the refrigerant temperature being sensed, which results in a prompt change in the pressure in the fluid filled chamber which acts upon the diaphragm. Sudden changes in pressure in the fluid filled chamber create a corresponding change in the flow through the control valve, which can result in overcontrol or undesirable oscillations in refrigerant flow in the evaporator. These transients can result from engine speed changes, brief changes in condenser or evaporator fan speeds accumulated oil cascading in the evaporator or other causes.

The time constant for this sensed temperature change, and resulting pressure change, is typically on the order of two seconds to achieve 63% of the eventual change or asymptotic limit. However in some systems, it has been found necessary to provide a longer time constant to prevent the system from responding to such transients. In systems requiring an extended-time response period, constants on the order of five seconds minimum and approximately 40 seconds maximum have been needed.

In order to dampen or retard the effects of temperature transients in refrigerant discharging from the evaporator, it has been the practice in known valves to insulate the actuator rod with a jacket 4. This technique has not been entirely satisfactory for ensuring a desired action of the controls system; and, difficulties have been encountered in providing the desired rate of response where time constants longer than ten seconds are needed with such insulation in a design which permits mass production of valves for passenger automobile air conditioning systems. It has thus been desired to provide a low cost, easy-to-manufacture thermostatic refrigerant expansion valve which has an easily alterable speed of thermal response for achieving the desired action for controlling flow in a refrigeration system such as an automotive air conditioning system.

SUMMARY OF THE INVENTION

The present invention provides a unique and novel thermally responsive expansion valve particularly suitable for controlling flow of refrigerant fluid in a refrigeration or an air conditioning system, and has a valve body with an inlet, outlet, and valve member movable to control flow therebetween and a separate continuous passage through the valve body adapted for connection to receive therethrough flow of refrigerant discharging from the system evaporator for return to the compressor inlet.

The valve member is moved by an actuator which includes a rod passing through the return passage with a hollow formed in the rod. The distal end of the rod is connected to a pressure responsive diaphragm which is exposed to fluid pressure in a fluid filled chamber external to the valve body. The hollow in the rod is in fluid communication with the fluid in the chamber. The actuator rod is in thermally conductive or heat transfer relationship with the refrigerant return flow through the contiguous passage. The fluid in the rod responds to changes in the temperature of the refrigerant flow in the return passage to effect changes in the pressure of the fluid in the fluid filled chamber; and, the pressure of the fluid in the chamber acts on a diaphragm operatively connected to effect movement of the valve actuator rod.

Flow restricting means comprising in one embodiment a hollow tubular member defining a metering orifice and in other embodiments a plug defining a metering orifice, and in one embodiment a porous plug is provided in the hollow portion of the actuator rod to retard the flow of fluid through the chamber having fluid acting on the diaphragm. The metering orifice functions to slow the fluid flow to the fluid filled chamber and thus slows pressure changes therein and prevents the valve from responding to transient changes in the temperature of the refrigerant discharging from the evaporator.

In another aspect of the invention, the present invention provides for improved ease of manufacture and facilitating of sealing of the pressure responsive diaphragm and actuator rod and incorporates the metering orifice in a plug or tubular member which is secured and sealed with the diaphragm and actuator, preferably by common weldment.

BRIEF DESCRIPTION OF THE DRAWINGS

FIG. 4 is a view similar to FIG. 3, showing another embodiment of the present invention;

FIG. 5 is a view similar to FIG. 3, showing still another embodiment of the present invention;

In the typical refrigerant-charged device, some condensed refrigerant is retained in the hollow end by means of a screen or spiral spring 5 installed in the open end of the hollow. In an absorption-charge device, the screen is used to retain the absorbant material in the hollow.

DETAILED DESCRIPTION

Figure 1:
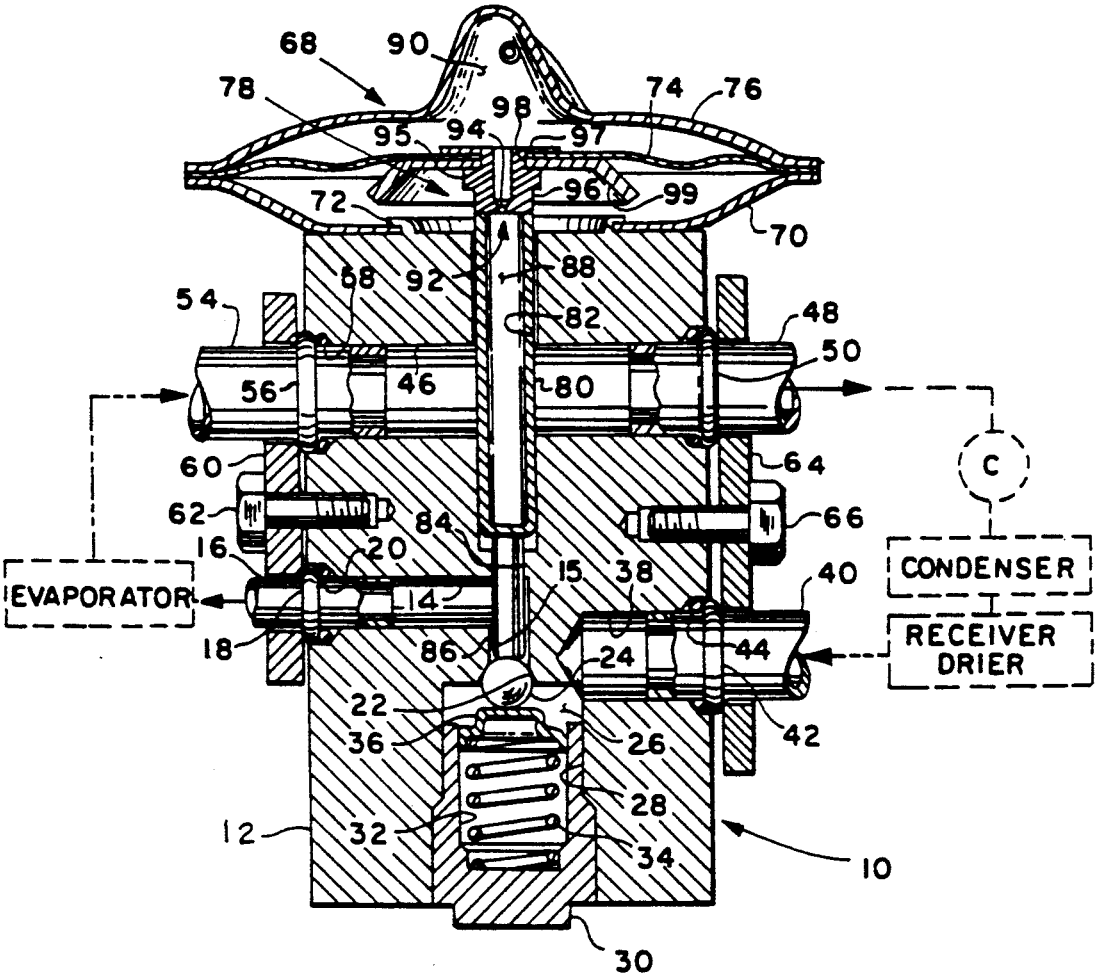
FIG. 1 is a cross-section of a refrigerant expansion valve of the block type embodying the principles of the present invention.

Referring to FIG. 1, the valve assembly is indicated generally at 10 and has a valve body 12 with an outlet passage 14 shown as having a conduit in the form of tube 16 connected thereto by means of a flange 18 formed on the tube and compressing a seal 20. Conduit 16 is adapted for connection to provide reduced pressure flow to the refrigerant evaporator. The outlet passage 14 communicates with a bore 15 which communicates with valve seat 22. A movable valve member 24 is associated therewith and typically has the form of a sphere. The valve seat and passage 15 communicate with an inlet chamber 26 formed by a bore 28 in the end of valve body 12, which bore is closed by a plug 30 threadedly engaging the body. The plug has a hollow 32 formed therein which has received therein a spring 34 having a cap 36 registered on the upper end thereof, which cap bears against the valve member 24 biasing the valve member to the closed position against valve seat 22.

The valving chamber 26 also communicates with an inlet passage 38 by intersection; and, passage 38 which has a conduit 40 received therein preferably with a flange 42 formed thereon which bears against a seal 44 for effecting sealing thereof in the inlet passage 38. Conduit 16 is adapted for connection to provide reduced pressure flow to the refrigerant evaporator. Inlet conduit 40 is adapted for connection to receive relatively high pressure refrigerant from the outlet of a refrigerant condenser.

It will be understood that the plug 30 is rotated to compress spring 34 to provide the desired pre-load on the spherical valve member 24 during calibration of the valve; and, the threads may then be sealed by any convenient technique as, for example, an anerobic sealant.

A separate through passage 46 is formed in the valve body 12 and has attached at one end thereof a tube or conduit 48 which has a flange 50 formed therearound, which flange is compressed against a seal 52 for sealing the tube in the passage 46. The tube 48 is adapted for connection to the inlet of a refrigerant system compressor for receiving therein the superheated vaporized refrigerant discharging from the evaporator. The opposite end of passage 46 has a tubing or conduit 54 received therein with a flange 56 provided thereon which flange compresses a seal 58 provided about the end of passage 46. Conduit 54 is adapted for connection to the suction inlet discharge side port of a refrigerant evaporator. The conduits 54,16, are retained on the valve body by a retainer 60 which is suitably configured to bear against the flanges 56,18 and is retained thereagainst by a suitable fastening means such as a screw 62 threadedly engaging the valve body 12. Similarly, conduits 48,40 are retained positioned and secured in place by a retainer 64 which is suitably configured out to bear against the flanges 50,42 and is retained thereagainst by a suitable fastener, such as screw 66 which threadedly engages valve body 12.

A thermally-responsive actuator means indicated generally at 68 has a concave annular lower shell portion 70 secured to the valve body 12. In the embodiment of FIG. 1 shell 70 is secured by a rolled-over flange 72 formed of the body material. An annular thin flexible diaphragm, preferably formed of metallic material is sealed about the periphery of the lower shell 70 and intermediate the periphery of an upper shell or cover 76. The upper and lower shells and the diaphragm are sealed and secured together by a suitable weldment such as, for example, laser welding, resistance welding, or brazing.

Diaphragm 74 has attached thereto an actuator rod means indicated generally at 78 which includes a hollow tubular member 80 slidably received in a bore 82 provided in the block 12, which bore 82 extends upwardly and opens into the interior of shell 70 and below the diaphragm 74. Bore 82 extends downwardly to intersect a passage 84 of smaller cross-section which communicates with the inlet passage 14 and which has a pin 86 received for sliding movement therein. Pin 86 is operative upon downward movement of the tubular member 80 to contact and move ball 24 from its seat.

The interior hollow 88 of rod 80 communicates with the interior 90 of shell 76 above diaphragm 74 via a flow-restricting means indicated generally at 92. As is known in the art, the chamber 90 and the interior hollow 88 of the rod 80 are charged with pressurized fluid as, for example, a combination of liquid and vaporized refrigerant or silicone oil. Changes in the temperature of the refrigerant flow through passage 46 cause increases or decreases in the pressure of the fluid in the hollow 88 of rod 80 and thus changes in the pressure in chamber 90, which as on diaphragm 74.

In the embodiment of FIG. 1, the flow restricting means 92 comprises a metering orifice 94 formed in a plug 96 which is secured through an aperture 98 through diaphragm 74. In the presently preferred practice, orifice 94 is sized at 0.005–0.010 inches (0.13–2.5 mm) for a valve construction having a ratio of the volume of chamber 90 to the volume of hollow 88 of about 4:1, when the diaphragm is in its "neutral plane" and the charge pressure is in the range of four atmospheres.

The plug is sealed and secured to the end of actuator rod 80 by any suitable expedient such as weldment. An annular backing plate 99 is provided around the aperture 98 on the undersurface of diaphragm 74; and, a washer 97 is provided on the upper surface of the diaphragm 74. The plug 96 has a portion extending upwardly through plate 99, diaphragm aperture 98, and a washer 97 to facilitate sealing and securement thereof. In the presently preferred practise the sealing and securement of the plug 96 with the diaphragm 74, plate 99, and washer 97 is accomplished by common weldment as, for example, laser, resistance or electron beam welding. However, it will be understood that the weldment may be accomplished with a suitable filler material as, for example, a brazing or welding filler material. Plug 96 has a flange or enlarged diameter portion 95 which forms a shoulder which is registered against the undersurface of plate 99.

Figure 2:
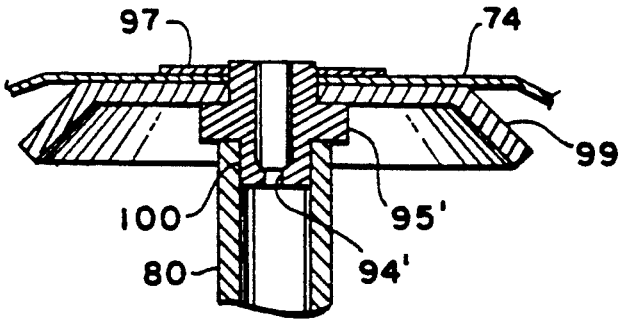
FIG. 2 is an enlarged view of a portion of FIG. 1 illustrating an alternate embodiment.

Referring to FIG. 2, an alternate embodiment is shown for the restrictor plug 95' and its attachment to rod 80. In the embodiment of FIG. 2, the plug 95 is assembled to the diaphragm backing plates and diaphragm identically as in FIG. 1; however, plug 95' has a pilot portion 100 extending downwardly into the hollow interior 88 of rod 80 to provide location and aid in the weldment thereto.

Figure 3:
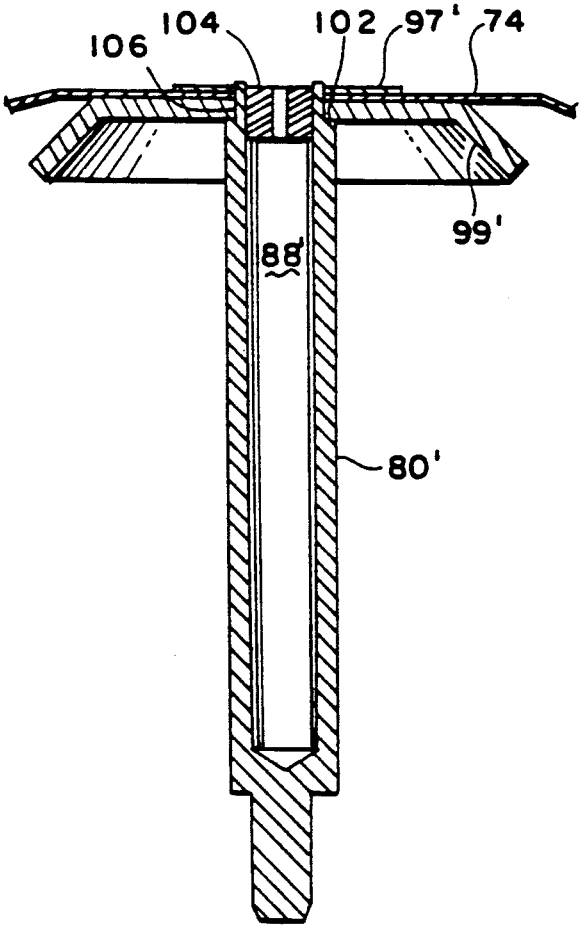
FIG. 3 is an enlarged view of a portion of FIG. 1 showing another embodiment of the invention.

Referring to FIG. 3, another embodiment on the construction of the hollow actuator rod 80' is shown, wherein the diaphragm lower backing plate 99' is received on a shoulder 102 formed on the top of the rod 80'. In the embodiment of FIG. 3, the restrictor plug 104 is received in the interior hollow 88' of the actuator rod 80' and plug 104 is secured therein commonly by the weldment of the backing plates 99',97', and diaphgram 74 over the reduced diameter portion 106 of the actuator rod 80'.

Referring to FIG. 4, another embodiment of the actuator rod/diaphragm assembly is shown wherein the rod 108 is formed integrally with the lower diaphragm backing plate 110; as, for example, by a deep drawing process. The diaphragm has an upper backing ring 112, which secures the diaphragm to the lower backing plate upon common weldment thereto. In the FIG. 4 embodiment, the restrictor comprises a porous plug, as for example, a powdered metal plug, is secured in the interior hollow 116 of the rod 108.

Referring to FIG. 5, another embodiment of the invention similar to the embodiment of FIG. 4 is shown, wherein the actuator rod 108' is formed separately from the lower backing plate 110' and is secured thereto by weldment. In the embodiment of FIG. 5, the restrictor orifice 118 is formed in the lower diaphragm backing plate, which is secured, to the plate by a ring 112', in a manner similar to the embodiment of FIG. 4.

Figure 6:
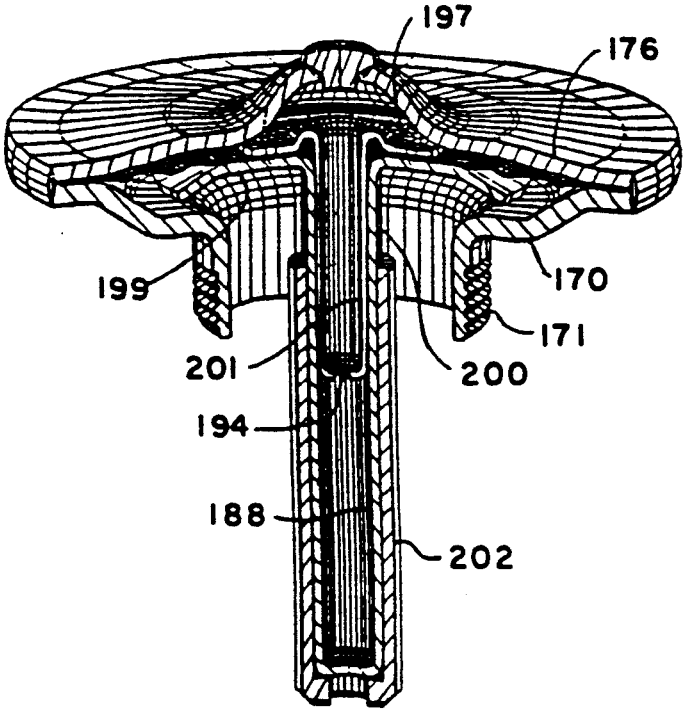
FIG. 6 is a quarter-section perspective view of a portion of the valve of FIG. 1, showing another embodiment of the invention employing a hollow tubular member forming the metering orifice; and, FIG. 7 is a view similar to FIG. 6, illustrating the prior art.
Figure 7:
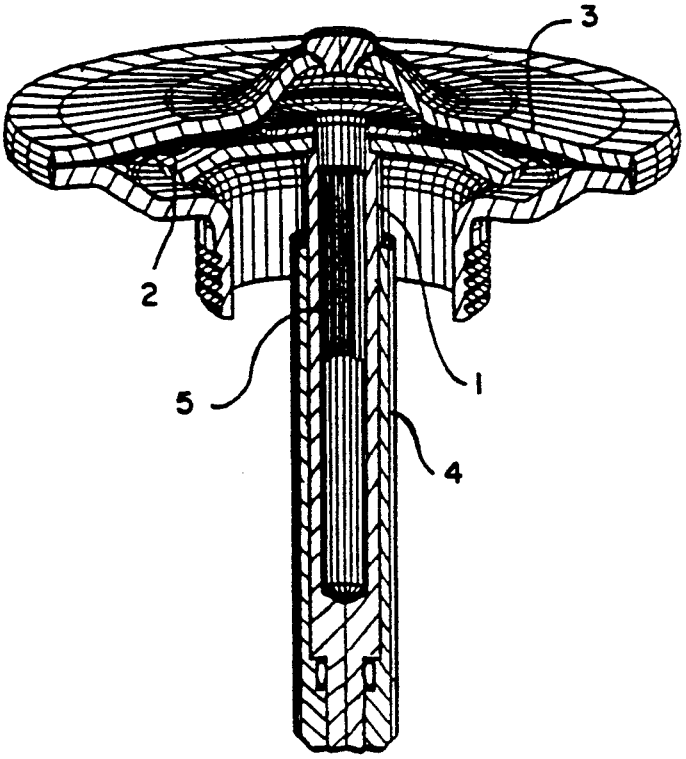
FIG. 7 (PRIOR ART)

Referring to FIG. 6, another embodiment of the invention is illustrated in which the lower shell 170 has integrally formed therewith a threaded collar 171 which is adapted to be threadedly engaged to the valve body. The diaphragm 174 is secured between the peripheral region of the lower shell 170; and, the cover 176 and the outer edge of the cover are secured to the periphery of the lower shell 170 by suitable weldment similar to the construction of the embodiment of FIG. 1. The diaphragm has received, through an aperture in the center thereof, a deep drawn cup portion 200 which is integrally formed in the central region of a lower backing plate 199; and, the lower end of the hollow central portion 200 is closed to form the interior hollow region 188. The upper diaphragm backing plate 197 in the embodiment of FIG. 6 also has a deep drawn central cup portion 201 which closely interfits the interior of the hollow 188 and which has the restriction orifice 194 formed in the lower end thereof. The upper diaphragm backing plate 197 and the lower plate 199 are secured and sealed to the diaphragm by a common weldment therethrough. A shroud or guide bushing 202 is received over the outer surface of the drawn cup portion 200, and the shroud 202 is sized to guide the cup 200 for movement in the valve body.

The present invention thus provides a unique construction for a thermally responsive refrigerant expansion valve in which the temperature sensing is accomplished by a hollow thermally conductive actuating rod for the valve which passes through the refrigerant return passage to the compressor. The hollow rod communicates with the fluid pressure chamber acting upon the power diaphragm. The communication between the two chambers is via a restricting orifice which is effective to dampen the effects of thermal transients in the system to substantially eliminate response of the valve to such transients. The restricting orifice is provided in different embodiments by providing a plug at the upper end of the hollow valve actuating rod and various constructions are described for commonly securing the rod and plug to the collar diaphragm by common weldment. In other embodiments, the hollow actuating rod is formed by a deep drawn cup which may be welded to or formed integrally with the lower diaphragm backing plate.

Although the invention has hereinabove been described with respect to the illustrated embodiments, it will be understood that the valve is capable of modification and variation, and the invention is limited only by the scope of the following claims.

We claim:

1. A thermally responsive expansion valve for refrigerant system comprising:

(a) body means defining an inlet and outlet and having a valve member movable in said body means for controlling flow between said inlet and outlet;

(b) said body means defining a continuous flow passage therethrough;

(c) actuator means including a hollow member disposed in heat exchange relationship with flow in said continuous flow passage, said hollow member filled with thermally active fluid, the pressure of which changes with temperature;

(d) pressure responsive means including a chamber filled with said fluid and operative in response to changes in pressure of said fluid to effect movement of said actuator means; and, (e) flow restriction means including a tubular member having a smaller diameter portion thereof received in said hollow member and having one end thereof forming a metering orifice with a larger diameter portion thereof extending into said fluid filled chamber and having said larger diameter portion secured to and sealed about said pressure responsive means, said metering orifice operable to retard fluid communication between said hollow member and said fluid filled chamber, wherein the thermal response of said valve is altered by said flow restricting means.

2. The expansion valve defined in claim 1, wherein said pressure responsive means comprises a diaphragm formed of metallic material; and, said diaphragm, said hollow member, and said restriction means are sealed and secured by weldment.

3. The valve defined in claim 1, wherein said actuator means includes a thin flexible annular diaphragm sealed between two annular members, with the larger diameter portion of said tubular member comprising one of said annular members.

4. The valve defined in claim 1, wherein said pressure responsive means comprises a diaphragm formed of metallic material; and, said diaphragm, said hollow member, and said larger diameter portion of said tubular member are secured and sealed by common weldment.

* * * * *